United States Patent [19]

Nemoto et al.

[11] 4,157,694

[45] Jun. 12, 1979

[54] METHOD OF PRODUCING A TIN-PLATED SEAMLESS CONTAINER

[75] Inventors: Tadashi Nemoto; Ryoichi Fukumoto, both of Yamaguchi; Kozi Hakoda, Kudamatsu, all of Japan

[73] Assignee: Tokyo Kohan Co. Ltd., Tokyo, Japan

[21] Appl. No.: 888,150

[22] Filed: Mar. 16, 1978

[51] Int. Cl.[2] ..... C25D 5/10; B21D 51/26

[52] U.S. Cl. ..... 113/120 A; 204/34; 204/40

[58] Field of Search ..... 204/34, 37 T, 40; 113/120 A; 220/64, 456, DIG. 22

[56] References Cited

U.S. PATENT DOCUMENTS

| | | | |
|---|---|---|---|
| 2,673,836 | 3/1954 | Vonada | 204/34 |
| 3,340,030 | 8/1967 | Notman | 204/40 |
| 3,522,154 | 7/1970 | Swalheim | 204/37 T |
| 3,620,934 | 11/1971 | Endle | 204/37 T |
| 3,655,349 | 4/1972 | Shah et al. | 220/456 |
| 4,033,274 | 7/1977 | Beese | 113/120 A |

*Primary Examiner*—John H. Mack
*Assistant Examiner*—William Leader
*Attorney, Agent, or Firm*—Wenderoth, Lind & Ponack

[57] ABSTRACT

An iron-tin alloy is formed electrochemically on a low carbon steel sheet or strip, and the low carbon steel sheet or strip is electro-plated with tin and then drawn and/or ironed to produce a seamless container.

5 Claims, 4 Drawing Figures

METHOD OF PRODUCING A TIN-PLATED SEAMLESS CONTAINER

BACKGROUND OF THE INVENTION

I. Field of the Invention

The present invention relates to a method of producing a seamless electrolytic tinplate container by drawing and/or ironing an electrolytic tinplate.

II. Description of the Prior Art

In the manufacture of seamless aluminum containers, the drawing and ironing process has been used. As materials used for seamless containers, electrolytic tinplates have also been used with economic advantages. A commercial electrolytic tinplate is made by continuously electrolytically plating tin onto steel and then the tin coating is normally melted and flow-brightened. Such commercial flow-melted electrolytic tinplate material is found to need a slightly greater load in the drawing and ironing operation than that of a non-flow-brightened electrolytic tinplate. This is because the iron-tin alloy formed by flow-melting is hard and brittle and results in an increase of friction between the steel substrate and the die during the drawing and ironing steps. Accordingly, a matte electrolytic tinplate material produced without a flow-melting operation is widely used for producing seamless containers because it does not require such a load in the drawing and ironing steps.

The reduction of the drawing and ironing load serves to extend the life of the tools used in such drawing and ironing operation and therefore, it is important to reduce the drawing and ironing load.

In producing the tin cans or containers on a commercial basis, the speed in the ironing operation today is about 120 cans or containers per minute and in some cases, the rate increases because of the productivity demands. However, as the ironing speed increases, certain disadvantages occur such as "frosting" and scratching on the exterior surface of the containers in the ironing step. This frosting phenomenon occurs because the temperature of the exterior surface of the container rises during the ironing operation and as a result, that portion of the container subjected to elevated temperatures becomes dim and lusterless. Presumably, this is due to the melting of the tin layer on the exterior surface of the containers during ironing step at the increased temperature. At any rate, regardless of the cause of the phenomenon, frosting does occur at such elevated temperatures and spoils the appearance of the exterior surface of the container.

From the above, it is quite apparent that there is a distinct need for improving the production of matte electrolytic tinplates by decreasing the drawing and ironing loads at high speeds and to prevent frosting and scratching of the surface of the containers during the ironing step at speeds of over 120 cans/min. On the basis of such knowledge, the present invention provides a method for obtaining a seamless container devoid of such problems by using an electrolytic tinplate having an iron-tin alloy formed electrochemically on a low carbon steel sheet or strip.

SUMMARY OF THE INVENTION

One object of the present invention is to provide a method of producing seamless containers which are readily and easily produced at reduced loads during the drawing and ironing steps.

Another object of the present invention is to provide the method of producing seamless containers in such a manner as to extend the life of the tools used for drawing and ironing the containers.

A further object of the present invention is to provide a method of producing seamless containers at high speeds which are free from the aforementioned frosting and scratches on the exterior surface of the containers.

Briefly described, the aforegoing objects are accomplished by electrochemically forming an iron-tin alloy on a low carbon steel sheet or strip, then electroplating the electrochemically treated carbon steel sheet or strip with tin and then drawing and/or ironing the sheet or strip to produce a seamless container.

BRIEF DESCRIPTION OF THE DRAWINGS

Referring to the drawings.

DESCRIPTION OF THE PREFERRED EMBODIMENTS

The steel is first electrolytically degreased in an alkaline or acid electrolyte following which the iron-tin alloy formed electrochemically according to the present invention is obtained by electrolytically tinplating a steel strip or sheet under the presence of a small amount of iron oxide on the steel surface with generation of hydrogen during the electro-plating.

According to this step, it is considered that a tin ion supplied by the tin electroplating step combines with an iron ion generated by reducing the iron oxide and the electrochemical formation of an iron-tin alloy takes place.

Figure 1:
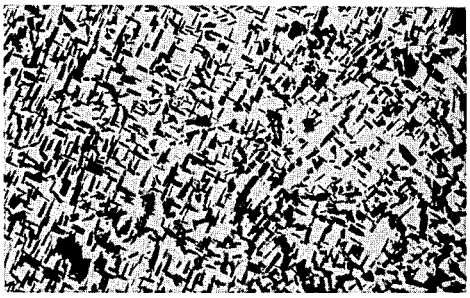
FIG. 1 is an electron microphotograph of an iron-tin alloy of a commercially flow-melted electrolytic tinplate, said microphotograph being magnified 5,000 times.
Figure 2:
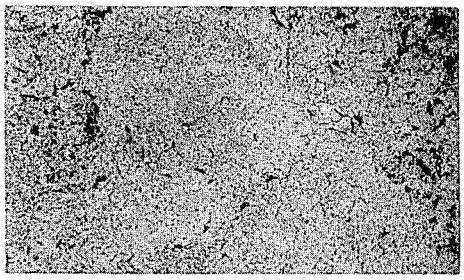
FIG. 2 is an electron microphotograph magnified 5,000 times of an iron-tin alloy formed electrochemically in accordance with the present invention.

In forming the iron-tin alloy according to the present invention, there can be used an acid or alkaline electrolyte. However, it is preferred to use an alkaline electrolyte as the electrolyte in forming the iron-tin alloy. When an acid electrolyte is used, hydrogen is generated in a low content stannous tin solution during electrolysis and thus the stannous tin solution containing less stannous tin content than 15 g/l is suitable. The morphology of the iron-tin alloy formed electrochemically according to the present invention differs from the iron-tin alloy formed by flow-melting as described in FIGS. 1 and 2 of the drawings. It is apparent that the iron-tin alloy formed electrochemically is very fine in structure. Indeed, it has been found that the friction between the steel substrate and the die used for the drawing and ironing operation is reduced by forming the fine iron-tin alloy and this fact is corroborated by the results of testing the material to evaluate the drawability and ironability thereof.

To accomplish the objects of the present invention, i.e. to reduce the load and to prevent frosting and scratching of the surface of the seamless tinplate container, the amount of the iron-tin alloy formed electrochemically on the surface of the steel sheet should be at least 0.005 g/m$^2$, calculated as tin. Also, to facilitate the drawing and ironing operation, the amount of alloy formed electrochemically should not exceed 0.2 g/m$^2$ in respect to the tin content.

THE EXAMPLES

The following is a description of various modes of carrying out the present invention.

EXAMPLE 1

The composition and mechanical properties of a cold rolled low carbon steel sheet which is used in the present invention are indicated in Table 1.

Table 1

| The Composition of the Steel (percent by weight) | |
|---|---|
| C | 0.05 |
| Mn | 0.30 |
| S | 0.015 |
| P | 0.014 |
| Si | 0.02 |
| Al | 0.054 |
| Cu | 0.007 |
| Cr | 0.056 |
| Fe | the balance |
| **The Mechanical Properties of the Steel** | |
| Ultimate tensile strength | 37.8 Kg/mm$^2$ |
| Yield strength | 26.1 Kg/mm$^2$ |
| Tensile elongation | 39.0% |
| Hardness | 49 Rockwell 30T |

Figure 3:
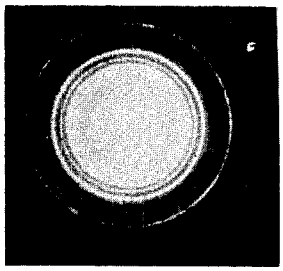
FIG. 3 is a pattern of electron diffraction for an iron-tin alloy formed electrochemically in accordance with the present invention.

The steel sheet of thickness 0.32 mm was electrolytically degreased in a 7% by weight solution of sodium hydroxide and rinsed in water. The sheet was then exposed in air for one second to form iron oxide on the steel sheet, then coated with tin in an amount of 0.05 g/m$^2$ in an acid electrolyte of low stannous tin content containing stannous tin in a concentration of 2.0 g/l and sulfuric acid in an amount of 5 g/l. In this electrolysis, the current density was 30 A/dm$^2$ and the current efficiency was 5%. The amount of an iron-tin alloy formed by the electrolysis was 0.01 g/m$^2$. The iron-tin alloy was identified as $FeSn_2$ from an analysis of the electron diffraction. The pattern of electron diffraction is shown in FIG. 3 and the result of electron diffraction analysis is indicated in Table 2.

The steel sheet was then electro-plated with tin in an amount of 5.6 g/m$^2$ in an acid electrolyte containing stannous tin in an amount of 30 g/l, sulfuric acid in an amount of 20 g/l and an additive agent in an amount of 5 g/l. In the electrolysis, the current density was 30 A/dm$^2$, and the current efficiency was 99%.

Figure 4:
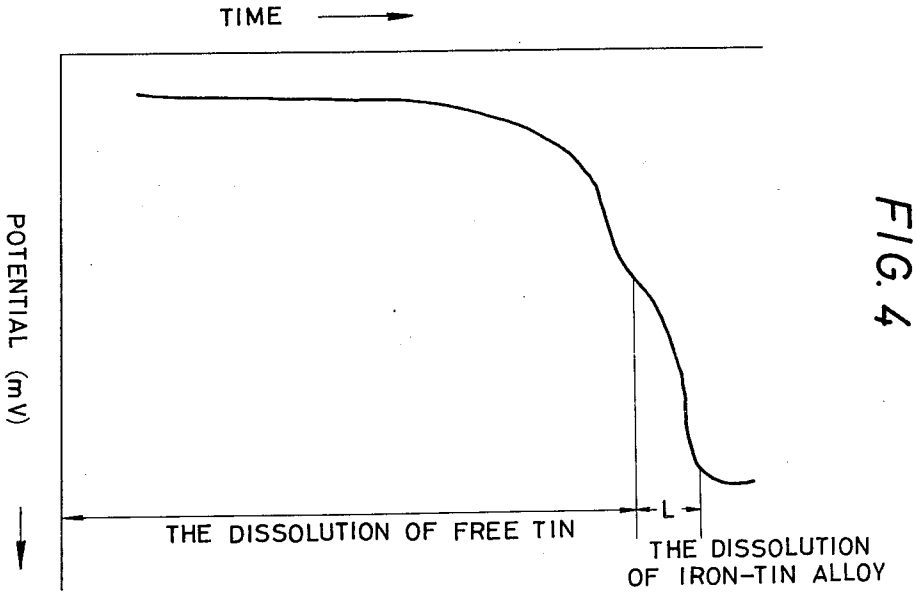
FIG. 4 is a potential-time curve of an electrolytic tinplate obtained in accordance with the present invention.

The electro-plated tinplate was then passivated in dilute sodium dichromate and rinsed and di-octyl sebacate (DOS) oil was then applied. The amount of the iron-tin alloy was measured by a coulometric method. The iron-tin alloy was determined by measuring the time (L in FIG. 4) corresponding to the dissolution of an iron-tin alloy in a recorded potential-time curve. The potential-time curve is shown in FIG. 4.

The results of the electron diffraction analysis for an iron-tin alloy formed by electrolysis are set forth in Table 2 below:

Table 2

| Lattice constant d (Angstroms) | |
|---|---|
| The results of analysis | $FeSn_2$* |
| 2.67 | 2.67 |
| 2.56 | 2.57 |
| 2.29 | 2.31 |

Table 2-continued

| Lattice constant d (Angstroms) | |
|---|---|
| The results of analysis | $FeSn_2$* |
| 2.05 | 2.07 |
| 1.70 | 1.64 |
| 1.62 | 1.54 |
| 1.50 | 1.52 |

*Depends on an X-ray powder data file (ASTM)

The electrolytic tinplate was cut into a circular blank having a diameter of 125.5 mm by means of a punch press. The flat circular blank was then drawn through a capping die by means of a drawing punch of 67.9 mm diameter.

After the drawing, the cup was passed through three ironing dies. The clearance between each of the dies and the punch of 52.7 mm diameter are shown in Table 3, in which case, the ironing speed was 180 cans/min.

Table 3

| The clearance between each of the dies and the punch in the ironing operation are as follows: | |
|---|---|
| | Clearance (mm) |
| 1st ironing | 0.29 |
| 2nd ironing | 0.18 |
| 3rd ironing | 0.10 |

As an evaluation of the formability of the tinplated containers, the area where frosting was expected to break out on the exterior surface of the seamless container was inspected and the maximum punch load at the third ironing operation was measured. The results are shown in Table 4.

EXAMPLE 2

A steel sheet of the same type as used in Example 1 was electrolytically degreased in a 5% by weight sodium hydroxide solution and rinsed in water. The sheet was then electrolytically treated by using anodic electrolysis in a 5% by weight sulfuric solution and rinsed. The existence of a small amount of iron oxide on the surface of the steel sheet was confirmed.

The steel sheet was then coated with tin in an amount of 0.1 g/m$^2$ in an alkaline electrolyte containing stannic tin in an amount of 40 g/l and sodium hydroxide in an amount of 15 g/l. In this electrolysis, the current density was 3 A/dm$^2$ and the current efficiency was 30%. The amount of iron-tin alloy formed by this electrolysis was 0.05 g/m$^2$. The iron-tin alloy was identified as $FeSn_2$ by electron diffraction analysis.

The steel sheet was then electro-plated with tin in an amount of 5.6 g/m$^2$ in an acid electrolyte containing stannous tin in an amount of 30 g/l, sulfuric acid in an amount of 20 g/l and an additive agent in the amount of 5 g/l. The electrolytic tinplate was then passivated in dilute sodium dichromate and rinsed, and di-octyl sebacate (DOS) oil was then applied to the surface thereof.

The electrolytic tinplate was tested and evaluated by the drawing and ironing process as described in Example 1.

EXAMPLE 3

A steel sheet of the same type as used in Example 1 was electrolytically degreased in a 5% by weight sodium hydroxide solution and rinsed in water.

The steel sheet was then coated with tin in an amount of 0.2 g/m$^2$ in an alkaline electrolyte containing stannic tin in15 g/l without pickling in sulfuric acid solution. In this electrolysis, the current density was 5 $A/dm^2$ and the current efficiency was 33%. The amount of an iron-tin alloy formed by electrolysis was 0.11 $g/m^2$. The iron-tin alloy was identified as $FeSn_2$ by electron diffraction analysis.

The steel sheet was electro-plated with tin in an amount of 5.6 $g/m^2$ in an acid electrolyte containing stannous tin in an amount of 30 g/l, sulfuric acid in an amount of 20 g/l and a conventional additive agent in an amount of 5 g/l. The electrolytic tinplate was then passivated in dilute sodium dichromate and rinsed and di-octyl sebacate (DOS) oil was then applied.

The electrolytic tinplate was tested and evaluated by the drawing and ironing process as described in Example 1.

The amount of frosting which broke out on the exterior surface of the seamless container produced according to the present invention and the maximum punch load during high speed ironing at 180 cans/min. are set forth in Table 4 below.

Table 4

| Example No. | Frosting which occured during the ironing step | Maximum punch load at the third ironing (Kg) |
|---|---|---|
| 1 | slight amount | 2490 |
| 2 | slight amount | 2470 |
| 3 | slight amount | 2685 |
| Flow-melted tinplate* | frosting occurs wholly on the external surface | 2950 |
| Matte tinplate without flow-melting* | heavy formation of frosting | 2830 |

*The amount of tin coating in the conventional electrolytic tinplate is 5.6 $g/m^2$.

As described in Table 4, it is evident that the electrolytic tinplate prepared by the method of the present invention significantly reduces the ironing punch load and prevents significant frosting on the exterior surface of seamless steel containers during the high speed ironing operation as compared with conventional electrolytic tinplates (flow-melted tinplate and matte tinplate without flow-melting).

What is claimed is:

1. A method of producing a seamless container which consists essentially of:

forming a first layer of an iron-tin alloy on a low carbon steel sheet or strip by first forming a small amount of iron oxide on the surface of the low carbon steel sheet or strip and then electrolytically tinplating the surface of said steel with the generation of hydrogen during the electroplating thereof to form the iron-tin alloy layer, said iron-tin alloy being present in an amount of 0.005 to 0.2 $g/m^2$ on said steel, calculated as the tin content in the iron-tin alloy;

electrolytically coating the surface of the thus-treated low carbon steel sheet or strip with tin to form a second tin layer, and subjecting the tinplated steel sheet or strip to a drawing or ironing operation or a combination of the drawing and ironing operations to form an electrolytic tinplate seamless container.

2. A method according to claim 1, wherein the iron-tin alloy is formed on the surface of the low carbon steel sheet or strip by electrolytically degreasing the surface of the strip or sheet in an alkaline or acid electrolyte, rinsing the surface thereof and then exposing the surface to air to form iron oxide in the steel sheet, followed by electroplating with a tin solution to form an iron-tin alloy on the surface thereof.

3. A method according to claim 2, wherein the surface of the low carbon steel sheet or strip is electrolytically degreased with an alkaline electrolyte.

4. A method according to claim 3, wherein the alkaline electrolyte is sodium hydroxide.

5. A method according to claim 2, wherein the surface of the low carbon steel sheet or strip is electrolytically degreased with an acid electrolyte.

* * * * *

UNITED STATES PATENT AND TRADEMARK OFFICE

CERTIFICATE OF CORRECTION

PATENT NO. : 4,157,694

DATED : June 12, 1979

INVENTOR(S) : TADASHI NEMOTO, RYOICHI FUKUMOTO

It is certified that error appears in the above-identified patent and that said Letters Patent are hereby corrected as shown below:

On the title page, next to "Assignee", change "Tokyo Kohan Co. Ltd." to -- Toyo Kohan Co. Ltd. --

Signed and Sealed this

*Eleventh* Day of *December 1979*

[SEAL]

*Attest:*

SIDNEY A. DIAMOND

*Attesting Officer*

*Commissioner of Patents and Trademarks*